US005275905A

United States Patent [19]

Ciccarelli et al.

[11] Patent Number: 5,275,905

[45] Date of Patent: Jan. 4, 1994

[54] MAGENTA TONER COMPOSITIONS

[75] Inventors: Roger N. Ciccarelli, Rochester; Don B. Jugle, Penfield, both of N.Y.

[73] Assignee: Xerox Corporation, Stamford, Conn.

[21] Appl. No.: 705,995

[22] Filed: May 28, 1991

[51] Int. Cl.[5] ..... G03G 9/00

[52] U.S. Cl. ..... 430/110; 430/45

[58] Field of Search ..... 430/110, 45

[56] References Cited

U.S. PATENT DOCUMENTS

| | | | |
|---|---|---|---|
| 4,078,929 | 3/1978 | Gundlach | 96/1.2 |
| 4,264,185 | 4/1981 | Ohta | 355/4 |
| 4,265,990 | 5/1981 | Stolka et al. | 430/59 |
| 4,525,447 | 6/1985 | Tanaka et al. | 430/122 |
| 4,777,105 | 10/1988 | Macholdt et al. | 430/110 |
| 4,789,615 | 12/1988 | Ciccarelli et al. | 430/110 |
| 4,828,954 | 5/1989 | Hashimoto et al. | 430/110 |
| 4,837,100 | 6/1989 | Murofushi et al. | 430/106.6 |
| 4,837,101 | 6/1989 | Gruber et al. | 430/109 |
| 4,845,003 | 7/1989 | Kiriu et al. | 430/110 |
| 4,883,736 | 11/1989 | Hoffend et al. | 430/110 |
| 4,937,167 | 6/1990 | Moffat et al. | 430/110 |
| 4,948,686 | 8/1990 | Koch et al. | 430/45 |

FOREIGN PATENT DOCUMENTS

| | | |
|---|---|---|
| 0275636 | 7/1988 | European Pat. Off. . |
| 0357454 | 3/1990 | European Pat. Off. . |

*Primary Examiner*—Marion E. McCamish
*Assistant Examiner*—Mark A. Chapman
*Attorney, Agent, or Firm*—E. O. Palazzo

[57] ABSTRACT

A toner comprised of resin particles, magenta pigment particles, and surface additive particles comprised of a mixture of colloidal silica, metal oxide, and a polymeric hydroxy compound.

30 Claims, No Drawings

MAGENTA TONER COMPOSITIONS

BACKGROUND OF THE INVENTION

The present invention is generally directed to toners, developers, and imaging processes, including a full color process for forming multiple color images, and more specifically, the present invention is directed to a process for obtaining multicolor, including two-color images which in an embodiment comprises charging an imaging member, creating on the member a latent image comprising areas of high, medium, and low potential, developing the low areas of potential with the magenta developer composition illustrated herein, subsequently developing the high areas of potential with a developer composition, transferring the developed image to a substrate, and optionally permanently affixing the image to the substrate. In embodiments, the toners and developers of the present invention can be utilized in specific color imaging processes, such as process color, and the like. An example of the aforementioned development process comprises a developer housing with a twin auger transport single magnetic brush design mounted in the approximate 6 o'clock orientation. The magnetic brush roll (developer roll) is about 30 millimeters in diameter, sandblasted for roughness, and preferably operates at about 1.5 times the speed of the photoreceptor, or imaging member. The developer roll is spaced about 0.5 millimeter from the photoreceptor and is biased with a square wave 550 volt RMS 2.0 KHz AC bias added to the DC bias which is variable between 0 and −500 volts depending upon the photoreceptor discharge characteristics, and the desired xerographic developability established by the control algorithm. A stationary magnet is situated internal to the rotating developer roll sleeve, and is comprised of a ferrite with a designed magnetic pole configuration to satisfy the requirements of controlling the developer transport and developability. The developer flow (termed Mass on the Sleeve, or MOS) can be controlled by the location of a low permeability trimmed bar in the magnetic field at the point of trimming. Typically, the MOS is set at $33\pm3$ mg/cm$^2$ and is sensitive to the trim gap, toner concentration (TC) and developer tribo, hence, the developer housing has a toner concentration sensor as part of the process control circuitry. The twin augers in the developer housing sump transport the developer in opposite directions, first past the toner dispenser then to the developer pick up region of the developer roll. The augers have slits built into them in order to facilitate the mixing of the fresh toner added to the developer. Usually a number of latent images are formed and developed sequentially on the imaging member with an appropriate toner, such as that of the present invention for the magenta color. Another embodiment of the present invention relates to magenta toners comprised of toner resin particles, colored pigment particles, especially flushed FANAL PINK D4830 TM (BASF), an optional negative charge enhancing additive, surface additives, such as colloidal silicas, like AEROSIL ®#76, tin oxide, especially a tin oxide available as S-1; and polymeric hydroxy surface additives, such as UNILINS ®, reference U.S. Pat. No. 4,883,736, the disclosure of which is totally incorporated herein by reference. The toner in embodiments can be comprised of resin particles, a magenta pigment, preferably flushed into the toner resin, and surface additives of colloidal silica and UNILIN ®.

A number of advantages are associated with the toner of the present invention in embodiments thereof, including significantly improved color especially in the red and blue region, lower cost, lower fuser minimum fixing temperature (MFT), and improved fuser life. In another embodiment, there can be added to the toner a negative charge additive, such as an aluminum complex, as mentioned herein like BONTRON E-88 TM, available from Orient Chemical, thereby lowering the triboelectrical charge of the toner in embodiments; and the use of a common carrier for each colored toner. Also, there are provided in accordance with the present invention processes for obtaining passivated magenta toners, and more specifically wherein the magenta pigments are passivated thereby decreasing, or substantially eliminating their adverse effects on the electrical characteristics of the toner and developer compositions containing such pigments. Other advantages associated with the present invention include the provision of a developer with stable positive triboelectrical toner characteristics which enables the generation of high quality images subsequent to development, that is images with substantially no background deposits and substantially no smearing for a broad range of relative humidity conditions, that is for example from 20 to 80 percent relative humidity at an effective range of temperature zones ranging, for example, from about 20° C. to about 80° C.

Passivation can be achieved by, for example, the admixing of the magenta pigment and charge additives with the toner resin particles. One advantage associated with the processes of the present invention is the ability to generate high quality multicolor, especially three, images, one of which is magenta, and the other of which can be yellow and cyan in a single development pass.

Toner compositions with colored pigments are known. For example, there are disclosed in U.S. Pat. No. 4,948,686, the disclosure of which is totally incorporated herein by reference, processes for the formation of two color images with a colored developer comprised of a first toner comprised of certain resin particles, such as styrene butadiene, a first pigment such as copper phthalocyanine, a charge control additive, colloidal silica and metal salts of fatty acid as external surface additives, and a first carrier comprised of a steel core with, for example, a terpolymer overcoating; and a second developer comprised of a black toner, a second charge additive and a steel core carrier with certain polymeric overcoatings, see Claim 1 for example. Examples of colored toner pigments are illustrated in column 9, lines 10 to 26, and examples of charge additives for the toner are detailed in column 9, lines 27 to 43, of the aforementioned patent. For the black toner, there can be selected the components as recited in columns 10 and 11, including charge additives such as distearyl dimethyl ammonium methyl sulfate, see column 11, lines 16 to 32. Additionally, the working Examples of this patent detail the preparation of a number of specifc toners. Also, there is illustrated in U.S. Pat. No. 4,948,686 a process for forming two-color images which comprises, for example, (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of methyl terpolymer, polymethyl methacrylate, and a blend of from about 35 to about 65 percent by weight of polymethyl methacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate. Imaging members suitable for use with the process of the copending application may be of any type capable of maintaining three distinct levels of potential. Generally, various dielectric or photoconductive insulating materials suitable for use in xerographic, ionographic, or other electrophotographic processes may be selected for the above process. Examples of suitable photoreceptor materials include amorphous silicon, layered organic materials as disclosed in U.S. Pat. No. 4,265,990, the disclosure of which is totally incorporated herein by reference, and the like.

Processes for obtaining electrophotographic, including xerographic, and two-colored images are known. In U.S. Pat. No. 4,264,185, the disclosure of which is totally incorporated herein by reference, there is illustrated an apparatus for forming two-color images by forming a bipolar electrostatic image of a two-color original document on a photoconductive drum. A first developing unit applies a toner of a first color and polarity to the drum and a second developing unit applies a toner of a second color and polarity to the drum to form a two-color electrostatic image which is transferred and fixed to a copy sheet. A bias voltage of the first polarity is applied to the second developing unit to repel the toner of the first color and prevent degradation of the first color toner image. A bias voltage of the second polarity is applied to the first developing unit to prevent contamination of the first color toner with the second color toner. Also, the following United States patents are mentioned: U.S. Pat. No. 4,308,821 wherein there is disclosed a method and apparatus for forming two-color images which employs two magnetic brushes; U.S. Pat. No. 4,378,415, which discloses a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively changed toner components, and carrier particles; U.S. Pat. No. 4,430,402, which discloses a two-component type dry developer for use in dichromatic electrophotography which comprises two kinds of developers, each of which is comprised of a toner and a carrier, and wherein dichromatic images can be formed by developing a positively and negatively electrified electrostatic latent image successively with toners different in polarity and color from each other; U.S. Pat. No. 4,594,302 which discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner; U.S. Pat. No. 4,500,616 which discloses a method of developing electrostatic latent images by selectively extracting colored grains of one polarity from a mixture containing colored grains having opposite polarity to each other in the presence of an alternating field, followed by development of the electrostatic image by the selectively extracted colored grains; U.S. Pat. No. 4,524,117 which discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer; U.S. Pat. No. 4,525,447, which discloses an image forming method which comprises forming on a photosensitive member an electrostatic latent image having at least three different levels of potentials, or comprising first and second latent images and developing the first and second latent images with a three component developer; U.S. Pat. No. 4,539,281, which discloses a method of forming dichromatic copy images by forming an electrostatic latent image having a first image portion and a second image portion; U.S. Pat. No. 4,562,129, which illustrates a method of forming dichromatic copy images with a developer composed of a high-resistivity magnetic carrier and a nonmagnetic insulating toner, which are triboelectrically chargeable; U.S. Pat. No. 4,640,883, which discloses a method of forming composite or dichromatic images which comprises forming on an imaging member electrostatic latent images having at least three different potential levels, the first and second latent images being represented, respectively, by a first potential and a second potential relative to a common background potential; U.S. Pat. Nos. 4,045,218 and 4,572,651. The disclosure of each of the aforementioned United States patents are totally incorporated herein by reference.

The process of charging a photoresponsive imaging member to a single polarity and creating on it an image comprised of at least three different levels of potential of the same polarity is illustrated in U.S. Pat. No. 4,078,929, the disclosure of which is totally incorporated herein by reference. This patent discloses a method of creating two-colored images by forming on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color and, in a subsequent development step, developed with negatively charged toner particles of a second color. Alternatively, charge patterns may be developed with a dry developer containing toners of two different colors in a single development step. Also of interest with respect to the trilevel process for generating images is U.S. Pat. No. 4,686,163, the disclosure of which is totally incorporated herein by reference.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can comprise areas of potential at −800, −400, and −100 volts. In addition, the levels of potential may comprise ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ depending upon the type of imaging member selected.

Moreover, illustrated in copending application U.S. Ser. No. 500,335/91, the disclosure of which is totally incorporated herein by reference, are developers, toners and imaging processes thereof. In an embodiment of the copending application, there is provided a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin particles, colored, other than black, pigment particles, and an aluminum complex charge enhancing additive; (4) subsequently developing the high areas of potential by conductive magnetic brush development with a developer comprising a second black developer comprised of carrier particles and a toner comprised of resin, black pigment, such as carbon black, and a charge enhancing additive; (5) transferring the developed two-color image to a suitable substrate; and (6) fixing the image thereto. In an embodiment of the aforementioned copending application the first developer comprises, for example, a first toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, Pliolites®, crosslinked styrene acrylates, crosslinked styrene methacrylates, and the like wherein the crosslinking component is, for example, divinyl benzene, and mixtures thereof; a first colored blue, especially PV Fast Blue TM pigment present in an effective amount of from, for example, about 1 to about 15 percent by weight, and preferably from about 1 to about 3 weight percent; an aluminum complex charge enhancing additive; and a second developer comprised of a second toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, Pliolites®, crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about 1 to about 5 weight percent wherein the aforementioned black toner contains a charge enhancing additive such as an alkyl pyridinium halide, and preferably cetyl pyridinium chloride, and in a preferred embodiment the black toner is comprised of 92 percent by weight of a styrene n-butyl methyacrylate copolymer (58/42), 6 percent by weight of Regal 330® carbon black, and 2 percent by weight of the charge enhancing additive cetyl pyridinium chloride.

Illustrated in copending application U.S. Ser. No. 547,362/91, the disclosure of which is totally incorporated herein by reference, is a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin, a positively charging pigment, and a negatively charging pigment; (4) subsequently developing the high areas of potential by conductive magnetic brush development with a developer comprising a second developer comprised of carrier particles and a toner comprised of resin, black pigment, such as carbon black, and a charge enhancing additive; (5) transferring the developed two-color image to a suitable substrate; and (6) fixing the image thereto.

SUMMARY OF THE INVENTION

It is a feature of the present invention to provide toner and developer compositions, and imaging processes thereof.

It is another feature of the present invention to provide imaging processes for obtaining multicolor images.

It is another feature of the present invention there are provided passivated magneta toner compositions.

In is still another feature of the present invention there are provided magneta toner pigments, thereby enabling toners with stable triboelectrical characteristics.

Another feature of the present invention is to provide a process for forming multicolor, that is for example known full process color with cyan, magenta, and yellow toners enabling full color images.

Another feature of the present invention is to provide a multicolor image formation wherein the developers are of specified triboelectric charge, charge distribution, and conductivity, and exhibit acceptable admix times and excellent developer lifetimes.

In another feature of the present invention there are provided toners comprised of resin particles, certain magenta pigments, an optional charge additive, and as surface additives UNILIN® and AEROSIL®, such as #76, available from Tayca Inc.

Also, in another feature of the present invention there are provided magenta toners with a negative aluminum complex charge additive.

These and other features of the present invention can be accomplished in embodiments by providing developers, toners and imaging processes thereof. In an embodiment of the present invention, there are provided toner compositions comprised of resin particles, magenta pigment particles, optional charge enhancing additive components, and surface additives comprised of colloidal silicas, and polymeric hydroxy compounds, such as UNILIN® components, available from Petrolite Corporation. Preferably, the magenta pigments are flushed into the toner by known methods, and as illustrated herein. Also, in another embodiment of the present invention there can be added to the toner negative charge additives, such as aluminum complexes, reference U.S. Pat. No. 4,845,003, the disclosure of which is totally incorporated herein by reference, like BONTRON E-88® available from Orient Chemical, which additives can function to lower the tribo of the toner, for example from about 35 to about a positive 17 to about a positive 25 microcoulombs per gram. The process of the present invention in embodiments comprises admixing resin particles with magenta pigment particles, and a positive charge enhancing additive or a negative charge enhancing additive like an aluminum complex such as BONTRON E-88® available from Orient Chemical of Japan, and thereafter adding surface additives thereto. Developers can be prepared by admixing the aforementioned toners with known carriers, such as steel, ferrites, and the like, which carriers are usually coated with a polymer, such as polymethylacrylate, KYNAR®, or mixtures thereof.

Also, the developers of the present invention can be selected for known full process color, and for obtaining two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a passivated colored magenta toner as illustrated herein; (4) subsequently developing the high areas of potential by conductive magnetic brush development with a developer comprising a second developer comprised of carrier particles and a toner comprised of resin, black pigment, such as carbon black, and a charge enhancing additive; (5) transferring the developed two-color image to a suitable substrate; and (6) fixing the image thereto.

Examples of known resin particles selected for the toners of the present invention include styrene acrylates, styrene methacrylates, polyesters, crosslinked styrene methacrylates, styrene butadienes, especially those with a high, such as from about 80 to about 95 weight percent styrene content, like the commercially available Goodyear PLIOLITES®, PLIOTONES®, and the like. The resin is present in an effective amount of from, for example, about 70 to about 98 percent by weight. Specific toner resins include known styrene acrylates, styrene methacrylates (58/32), linear, and branched polyesters, Pliolites®, Pliotones® available from Goodyear Chemical Company, styrene-butadiene polymers, particularly styrene-butadiene copolymers wherein the styrene portion is present in an amount of from about 83 to about 93 percent by weight, and preferably about 88 percent by weight, and the butadiene portion is present in an amount of from about 7 to about 17 percent by weight, and preferably about 12 percent by weight. Also suitable are styrene-n-butylmethacrylate polymers, particularly those styrene-n-butylmethacrylate copolymers wherein the styrene segment is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins may also be selected.

Examples of magenta pigments include HOSTAPERM PINK E TM, available from American Hoechst, HOSTAPERM PINK EB TM, available from American Hoechst, FANAL PINK D4830 TM, available from BASF, LITHOL RUBINE NBD 4573 TM, available from BASF, effective mixtures thereof, such as for example mixtures of HOSTAPERM PINK EB TM, or HOSTAPERM PINK E TM with BASONYL RED 560 TM available from BASF. The aforementioned magenta pigment is present in the toner in various effective amounts, such as for example from about 0.1 to about 15 weight percent, and preferably from about 1 to about 5 weight percent. Also, in embodiments for the magenta toner about 3.2 weight percent of HOSTAPERM PINK E TM with 0.1 to 0.3 weight percent of BASONYL RED 560 TM can be selected per 100 parts of toner.

Optional charge enhancing additives, which are present in the toner in various effective amounts, such as from about 0 to about 20, and preferably from about 0.05 to about 3 weight percent, include known additives such as distearyl dimethyl ammonium methyl sulfate, cetyl pyridinium halide, especially the chloride, bisulfides, and mixtures thereof in embodiments. Examples of specific charge additives include alkyl pyridinium halides, and preferably cetyl pyridinium chloride, reference U.S. Pat. No. 4,298,672, the disclosure of which is totally incorporated herein by reference, organic sulfates and sulfonates, reference U.S. Pat. No. 4,338,390, the disclosure of which is totally incorporated herein by reference; distearyl dimethyl ammonium methyl sulfate (DDAMS), reference U.S. Pat. No. 4,560,635, the disclosure of which is totally incorporated herein by reference; and the like. This toner in embodiments usually possesses a positive charge of from about 10 to about 45 microcoulombs per gram, and preferably from about 5 to about 25 microcoulombs per gram, which charge is dependent on a number of known factors, including the amount of charge enhancing additive present, and the exact composition of the other compositions such as the toner resin, the pigment, the carrier core, and the coating selected for the carrier core; and an admix time of from about 15 to about 60 seconds and preferably from about 15 to about 30 seconds. These additives are present in various effective amounts of, for example, from about 0.1 to about 20 weight percent and preferably from about 1 to about 10 weight percent. In the preparation of the colored and toner compositions, normally the products obtained comprised of toner resin, pigment and optional charge enhancing additive can be subjected to micronization and classification, which classification is primarily for the purpose of removing fines, and substantially very large particles to enable, for example, toner particles with an average volume diameter of from about 5 to about 25 microns, and preferably from about 10 to about 20 microns. The aforementioned toners may include as surface or external components additives in an effective amount of, for example, from about 0.1 to about 3 weight percent, colloidal silicas, such as AEROSIL 972®, metal salts, metal salts of fatty acids, especially zinc stearate, reference for example U.S. Pat. Nos. 3,590,000; 3,655,374; 3,900,588 and 3,983,045, the disclosures of which are totally incorporated herein by reference, metal oxides and the like as illustrated herein for the primary purpose of controlling toner conductivity and powder flowability. Examples of specific external additives of colloidal silica, include Aerosil R972®, Aerosil R #76®, Aerosil R812®, and the like, available from Degussa, and metal salts or metal salts of fatty acids, such as zinc stearate, magnesium stearate, aluminum stearate, cadmium stearate, and the like, may be blended on the surface of the colored toners. Toners with these additives blended on the surface are disclosed in the prior art such as U.S. Pat. Nos. 3,590,000; 3,720,617; 3,900,588 and 3,983,045, the disclosures of each of which are totally incorporated herein by reference. Generally, the silica is present in an amount of from about 0.1 to about 2 percent by weight, and preferably from about 0.3 percent by weight of the toner, and the stearate is present in an amount of from about 0.1 to about 2 percent by weight, and preferably about 0.3 percent by weight of the toner. Varying the amounts of these two external additives enables adjustment of the charge levels and conductivities of the toners. For example, increasing the amount of silica generally adjusts the triboelectric charge in a negative direction and improves admix times, which is a measure of the amount of time required for fresh toner to become triboelectrically charged after coming into contact with a developer. In addition, increasing the amount of stearate improves admix times, renders the developer composition more conductive, adjusts the triboelectric charge in a positive direction, and improves humidity insensitivity.

Moreover, the toners of the present invention contain as surface additives polyhydroxy compounds, such as UNILINS® available from Petrolite Corporation, reference U.S. Pat. No. 4,883,736, the disclosure of which is totally incorporated herein by reference. These additives are present in various effective amounts, such as for example from about 1 to about 10, and preferably from about 1 to about 3 weight percent.

As negative charge additives there may be selected in effective amounts of, for example, from about 0.1 to about 10 weight percent metal complexes, such as BONTRON E-84 TM, BONTRON E-88 TM, available from from Orient Chemicals. The toners with the aforementioned negative charge additives are comprised in embodiments of, for example, flushed FANAL PINK D4830 TM comprised of about 40 percent of pigment and 60 percent of toner resin like styrene butadiene copolymer, BONTRON E-88 TM, and as surface additives a mixture of AEROSIL #76®, a metal oxide, such as a tin oxide S-1, and UNILIN®, and wherein the carrier particles are comprised of, for example, a ferrite, especially a copper zinc ferrite available from Steward Chemical Company with a coating mixture of, for example, polyvinylfluoride (KYNAR®), 40 weight percent, and polymethyl methacrylate, 60 weight percent. The aforementioned additive mixture is present in various effective amounts, such as for example from about 0.4 to about 1.0 weight percent of the Aerosil R#76®, from about 0.4 to about 0.8 weight percent of the metal oxide available from Mitsubishi Corporation, as S-1, and from about 0.4 to about 0.8 weight percent of the UNILIN®, available from Petrolite Corporation. Other effective amounts of the mixture may be selected.

The carrier for the magenta developer in an embodiment of the present invention can be comprised of a steel core with an average diameter of from about 25 to about 225 microns, and a coating thereover selected from the group consisting of methyl terpolymer, polymethyl methacrylate, and a blend of from about 35 to about 65 percent by weight of polymethyl methacrylate and from about 35 to about 65 percent by weight of chlorotrifluoroethylene-vinyl chloride copolymer, wherein the coating contains from 0 to about 40 percent by weight of the coating, conductive particles, such as carbon black, like VULCAN® carbon black, and wherein the coating weight is from about 0.2 to about 3 percent by weight of the carrier. The carrier for the black developer can be comprised of a steel core with an average diameter of from about 25 to about 225 microns, and a coating thereover selected from the group consisting of chlorotrifluoroethylene-vinyl chloride copolymer containing from 0 to about 40 percent by weight of conductive particles, and wherein the coating weight is from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier. The carriers in embodiments are generally conductive, and exhibit in an embodiment of the present invention a conductivity of, for example, from about $10^{-14}$ to about $10^{-6}$, and preferably from about $10^{-11}$ to about $10^{-7}$ (ohm-cm)$^{-1}$. Conductivity is generally controlled by the choice of carrier core and coating by partially coating the carrier core, or by coating the core with a coating containing carbon black until the carrier is rendered conductive. In addition, irregularly shaped carrier particle surfaces and toner concentrations of from about 0.2 to about 5 can render the developer conductive. Addition of a surface additive such as zinc stearate to the surface of the toner particles also can render a developer conductive with the level of conductivity rising with increased concentrations of the additive. Other known carriers may also be selected, including the carriers as illustrated in U.S. Pat. No. 4,883,736, the disclosure of which is totally incorporated herein by reference, and U.S. Pat. Nos. 4,937,166 and 4,935,326, the disclosures of which are totally incorporated herein by reference. The aforementioned carriers in one embodiment comprise a core with two polymer coatings not in close proximity in the triboelectric series.

More specifically, the carrier for the developers of the present invention can comprise ferrite, iron or a steel core, preferably unoxidized, such as Hoeganes Anchor Steel Grit, with an average diameter of from about 25 to about 215 microns, and preferably from about 50 to about 150 microns, with one preferred carrier being a copper zinc ferrite available from Steward Chemical, coated with a polymers, such as a mixture of KYNAR®, and polymethyl methacrylate, by powder coating processes as illustrated in U.S. Pat. Nos. 4,937,166 and 4,935,326. The carrier cores can also be coated with a solution coating of methyl terpolymer, reference for example U.S. Pat. Nos. 3,467,634 and 3,526,533, the disclosures of which are totally incorporated herein by reference, containing from 0 to about 40 percent by weight of conductive particles, such as carbon black or other conductive particles as disclosed in U.S. Pat. No. 3,533,835, the disclosure of which is totally incorporated herein by reference. Also, the carrier coating may comprise polymethyl methacrylate containing conductive particles in an amount of from 0 to about 40 percent by weight of the polymethyl methacrylate, and preferably from about 10 to about 20 percent by weight of the polymethyl methacrylate, wherein the coating weight is from about 0.2 to about 3 percent by weight of the carrier and preferably about 1 percent by weight of the carrier. Another carrier coating for the carrier of the colored developer comprises a blend of from about 35 to about 65 percent by weight of polymethyl methacrylate and from about 35 to about 65 percent by weight of chlorotrifluoroethylene-vinyl chloride copolymer, commercially available as OXY 461® from Occidental Petroleum Company and containing conductive particles in an amount of from 0 to about 40 percent by weight, and preferably from about 20 to about 30 percent by weight, and wherein the coating weight is from about 0.2 to about 3 percent by weight of the carrier, and preferably about 1 percent by weight of the carrier.

Examples of imaging members selected for the processes of the present invention may be of any type capable of maintaining three distinct levels of potential. Generally, various dielectric or photoconductive insulating material suitable for use in xerographic, ionographic, or other electrophotographic processes may be used, such as amorphous silicon, layered organic materials as disclosed in U.S. Pat. No. 4,265,990, the disclosure of which is totally incorporated herein by reference, and the like. The photoresponsive imaging member can be negatively charged, positively charged, or both, and the latent image formed on the surface may comprise either a positive or a negative potential, or both. In one embodiment, the image is comprised of three distinct levels of potential, all being of the same polarity. The levels of potential should be well differentiated, such that they are separated by at least 100 volts, and preferably 200 volts or more. For example, a latent image on an imaging member can be comprised of areas of potential at −800, −400, and −100 volts. In addition, the levels of potential may be comprised of ranges of potential. For example, a latent image may comprise a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ depending upon the type of imaging member selected.

The latent image comprised of three levels of potential, hereinafter referred to as a trilevel image, may be formed on the imaging member by any of various suitable methods, such as those illustrated in U.S. Pat. No. 4,078,929, the disclosure of which is totally incorporated herein by reference. For example, a trilevel charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a trilevel charge pattern may be formed by means of a raster output scanner, optically modulating laser light as it scans a uniformly charged photoconductive imaging member. In this embodiment, the areas of high potential are formed by turning the light source off, the areas of intermediate potential are formed by exposing the imaging member to the light source at partial power, and the areas of low potential are formed by exposing the imaging member to the light source at full power. Other electrophotographic and ionographic methods of generating latent images are also acceptable.

Generally, with the process of the present invention in embodiments the highlighted areas of the image are developed with a developer comprised of the magenta passivated toner, while the remaining portions of the image are developed with the black developer illustrated herein comprised, for example, of resin particles, black pigment particles, such as carbon black, like REGAL 330® carbon black. In general, the highlighted color portions are developed first to minimize the interaction between the two developers, thereby maintaining the high quality of the black image.

Development is generally accomplished by the magnetic brush development process disclosed in U.S. Pat. No. 2,874,063, the disclosure of which is totally incorporated herein by reference. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred wherein the developer comprises conductive carrier particles and is capable of conducting an electric field between the biased magnet through the carrier particles to the photoreceptor. Conductive magnetic brush development is generally employed for the process of the present invention in view of the relatively small development potentials of around 200 volts that are generally available for the process; conductive development ensures that sufficient toner is presented on the photoreceptor under these development potentials to result in acceptable image density. Conductive development is also preferred to ensure that fringe fields occurring around the edges of images of one color are not developed by the toner of the other color.

During the development process, the developer housings can be biased to a voltage between the level of potential being developed and the intermediate level of charge on the imaging member. For example, if the latent image comprises a high level of potential of about −800 volts, an intermediate level of potential of about −400 volts, and a low level of about −100 volts, the developer housing containing the colored passivated positively charged toner that develops the high areas of potential may be biased to about −500 volts and the developer housing containing the negatively charged toner that develops the low areas of potential may be biased to about −300 volts. These biases result in a development potential of about −200 volts for the high areas of potential, which will be developed with a positively charged toner, and a development potential of about +200 volts for the low areas of potential, which will be developed with a negatively charged toner. Background deposits are suppressed by keeping the background intermediate voltage between the bias on the color developer housing and the bias on the black developer housing. Generally, it is preferred to bias the housing containing the positive toner to a voltage of from about 100 to about 150 volts above the intermediate level of potential and to bias the housing containing the negative toner to a voltage of from about 100 to about 150 volts below the intermediate level of potential, although these values may be outside these ranges.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

For the black developers comprised of a positively charge toner with a pigment such as carbon black, which developers can be comprised of similar components as the aforementioned colored magenta developers, with the exceptions that a black instead of magenta pigment is selected, and the charge enhancing additive is, for example, an alkyl pyridinium chloride, and preferably cetyl pyridinium chloride, which is present in an effective amount of, for example, from about 0.1 to about 10 weight percent, and preferably from about 1 to about 5 weight percent, are usually selected for the development of the high potentials. Examples of black developers suitable for the process of the present invention comprise a toner and a carrier. The carrier comprises in an embodiment of the present invention ferrite, steel or a steel core, such as Hoeganes Anchor Steel Grit, with an average diameter of from about 25 to about 215 microns, and preferably from about 50 to about 150 microns, with a coating of chlorotrifluoroethylene-vinyl chloride copolymer, commercially available as OXY 461® from Occidental Petroleum Company, which coating contains from 0 to about 40 percent by weight of conductive particles homogeneously dispersed in the coating at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as Tedlar® from E. I. DuPont de Nemours and Company, present in a coating weight of from about 0.01 to about 0.2, and preferably about 0.05 percent by weight of the carrier. The polyvinyl fluoride coating is generally coated onto the core by a powder coating process wherein the carrier core is coated with the polyvinyl fluoride in powder form and subsequently heated to fuse the coating. In one preferred embodiment, the carrier comprises an unoxidized steel core which is blended with polyvinyl fluoride (Tedlar®), wherein the polyvinyl fluoride is present in an amount of about 0.05 percent by weight of the core. This mixture is then heat treated in a kiln at about 400° F. to fuse the polyvinyl fluoride coating to the core.

Developer compositions selected for the processes of the present invention generally comprise various effective amounts of carrier and toner. Generally, from about 0.5 to about 5 percent by weight of toner and from about 95 to about 99.5 percent by weight of carrier are admixed to formulate the developer. The ratio of toner to carrier may vary depending, for example, on the tribo charge and the like desired. For example, an imaging apparatus employed for the process of the present invention may be replenished with a colored developer comprising about 55 percent by weight of toner and about 45 percent by weight of carrier. The triboelectric charge of the colored toners generally is from about 10 to about 30, and preferably from about 15 to about 20 microcoulombs per gram, although the value may be outside of this range. Particle size of the colored toners is generally from about 7 to about 20 microns in volume average diameter, and preferably about 13 microns in volume average diameter in embodiments.

The black positively charged toners may also optionally contain as an external additive a linear polymeric alcohol, or polyhydroxy compound, such as UNILIN®, comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number of from about 30 to about 300, and preferably from about 30 to about 50, reference U.S. Pat. No. 4,883,736, the disclosure of which is totally incorporated herein by reference. Linear polymeric alcohols of this type are generally available from Petrolite Chemical Company as Unilin®. The linear polymeric alcohol is generally present in an amount of from about 0.1 to about 1 percent by weight of the toner.

Black developer compositions may comprise from about 1 to about 5 percent by weight of the toner and from about 95 to about 99 percent by weight of the carrier. The ratio of toner to carrier may vary. For example, an imaging apparatus employed for the process of the present invention may be replenished with a colored developer comprising about 65 percent by weight of toner and about 35 percent by weight of carrier. The triboelectric charge of the black toners generally is from about −10 to about −30, and preferably from about −13 to about −18 microcoulombs per gram. Particle size of the black toners is generally from about 8 to about 13 microns in volume average diameter, and preferably about 11 microns in volume average diameter.

Preferably, the toners and developers of the present invention are selected for known full process color as illustrated herein.

The toners of the present invention may be prepared by processes such as extrusion, which is a continuous process that comprises dry blending the resin, pigment, and optional charge control additive, placing them into an extruder, melting and mixing the mixture, extruding the material, and reducing the extruded material to pellet form. The pellets are further reduced in size by grinding or jetting, and are then classified by particle size. In an embodiment of the present invention, toner compositions with an average particle size of from about 10 to about 25, and preferably from 10 to about 15 microns are preferred. External additives such as linear polymeric alcohols, silica, and/or metal oxides can then be blended with the classified toner in a powder blender. Subsequent admixing of the toners with the carriers, generally in amounts of from about 0.5 to about 5 percent by weight of the toner and from about 95 to about 99.5 percent by weight of the carrier, provides the developers of the present invention. Other known toner preparation processes can be selected including melt mixing of the components in, for example, a Banbury, followed by cooling, attrition and classification.

Flushing of the pigment, such as the magenta can be accomplished by admixing an aqueous presscake of the purchased pigment with an organic liquid, or an organic vehicle, like, for example, a synthetic resin/organic solvent mix, whereby the pigment transfers spontaneously to the organic phase, leaving the aqueous phase free of pigment. Some of the water can be removed by pouring, while any excess water remaing can be removed by heat and/or vacuum drying. The flushing process disperses the pigment into the aforementioned organic medium; and further dispersion can be accomplished by mixing in a sigma blade mixer. The sigma blade mixer can be equipped with a heat transfer jacket, and a high power to volume ratio. Normally, a 2 to 4 HP/gallon is selected for the mixing, and loading for the resin/pigment flushing is 2/3 of the volume capacity of the mixing bowl set up on pivots. The presscake selected is comprised of the pigment, such as magenta, dispersed in an aqueous phase, about 50 to about 70 percent water; the organic solvents can be toluene, xylenes, methyl ethyl ketone, chlorinated aliphatic components, and the like; and wherein the resin/pigment mixture resulting after flushing comprises from about 25 to about 45 percent of pigment. Subsequently, the resin mixture can be pulverized.

Embodiments of the present invention include a toner comprised of resin particles, magenta pigment particles, and surface additive particles comprised of a mixture of colloidal silica, metal oxide, and a polymeric hydroxy compound; a positively charged magenta toner comprised of resin, a flushed magenta pigment, a charge enhancing additive, and surface additive particles comprised of a mixture of colloidal silica and metal oxide particles; a color imaging process which comprises the development in sequence of latent images formed on an imaging member, and wherein one of the images is developed with the flushed magenta toner illustrated herein; or wherein a series of images are developed with the magenta toner illustrated herein, followed by development of an image with a yellow toner, and the development of a third image with a cyan toner.

The following Examples are provided. All parts and percentages are by weight unless otherwise indicated.

EXAMPLE I

A magenta developer composition was prepared as follows: Ninety four (94) percent by weight of styrene butadiene (89/11) 5 percent of the flushed pigment HOSTAPERM PINK E TM and 1 percent by weight of the charge additive distearyl dimethyl ammonium methyl sulfate were melt blended in an extruder wherein the die was maintained at a temperature of between 130° and 145° C., and the barrel temperature ranged from about 80° to about 100° C., followed by micronization and air classification to yield toner particles of a size of 11.5 microns in volume average diameter. The toner particles were then blended with 0.4 percent by weight of AEROSIL #76®, 0.8 weight percent of S-1 tin oxide, and 0.35 percent by weight of UNILIN®, reference Example I of U.S. Pat. No. 4,883,736, the disclosure of which is totally incorporated herein by reference, which UNILIN® was obtained from Petrolite Corporation. Subsequently, carrier particles were prepared by dry powder coating a 50 micron diameter copper zinc ferrite carrier obtained from Steward Chemical Company, 0.3 percent coating weight, with a mixture of KYNAR®, 43 weight percent, and polymethyl methacrylate, 57 weight percent. The resulting magenta developer was then prepared by blending 93 parts by weight of the coated carrier particles with 7 parts by weight of the magenta toner in a Lodige Blender for about 10 minutes resulting in a developer with a toner exhibiting a triboelectric charge of +15 microcoulombs per gram as determined in the known Faraday Cage apparatus at a toner concentration of 7 percent. Admix time for substantially uncharged added toner comprised of the same components of the above prepared toner is believed to be about 30 seconds as determined in the known charge spectrograph.

The above magenta developer can be incorporated into a full color imaging device, or an imaging device equipped to generate and develop trilevel images according to the method of U.S. Pat. No. 4,078,929, the disclosure of which is totally incorporated herein by reference. A full color or trilevel latent image was formed on the imaging member, and with respect to the trilevel the low areas of −100 volts potential were developed with the magenta developer, followed by development of the high areas of −750 volts potential with a black developer comprised of styrene butyl methacrylate resin, 90 weight percent, carbon black REGAL 330®, 8 weight percent, and 1 weight percent of the charge additive cetyl pyridinium chloride; and subsequent transfer of the two-color image to paper, and heat fusing of the image to the paper. Images formed exhibited excellent copy quality with substantially no background for 400,000 imaging cycles. Also, the aforementioned magneta toner exhibited stable triboelectric charging characteristics, that is the triboelectric charging properties remain relatively constant for 400,000 imaging cycles at relative humidities of from 20 to about 80 percent and at temperatures of from about 25° C. to about 70° C. at which time the test was terminated.

Preferably the magenta developer of this Example, and of the present invention can be selected for full color imaging wherein a negatively photoreceptor belt (P/R) comprised of an aluminum supporting substrate, a photogenerating layer of trigonal selenium in contact with the support, and an aryldiamine charge transport layer in contact with the photogenerating layer, and comprised of N,N'-diphenyl-N,N'-bis(3-methylphenyl) [1,1'-biphenyl]-4,4'-diamine molecules, about 60 weight percent dispersed in 40 weight percent of a polycarbonate, MAKROLON®, reference for example U.S. Pat. Nos. 4,265,990; 4,585,884; 4,584,253 and 4,563,408, the disclosures of which are totally incorporated herein by reference, is utilized. In the full color process, the following is accomplished.

The photoreceptor is exposed with an image, which will be black; the black image is then developed with the above black positively charged toner on the unexposed areas of the photoreceptor where the black latent image is present (charged area development or CAD), and wherein the development system is a DC biased magnetic brush which uses a small (50 microns in diameter) carrier of a copper, zinc ferrite. The black toner is then transferred from the photoreceptor to paper by a corotron transfer system; and the paper is held in a device which is registered with the photoreceptor and continues to circulate with the same velocity as the photoreceptor, which device could also be a drum, or an intermediate belt. Subsequently, the photoreceptor is cleaned and recharged negatively; and a magenta image is then exposed onto the photoreceptor, that is the photoreceptor is exposed everywhere on the photoreceptor where one does not want the above prepared magenta toner. The magenta image is developed on the unexposed areas of the photoreceptor where the magenta latent CAD image is present with the above prepared positively charged magenta toner, or the toner of the Examples that follow. The development system is a DC biased magnetic brush with an AC superimposed thereon, and wherein there is utilized the same small (50 microns in diameter) ferrite carrier. Thereafter, the above magenta toner is transferred from the photoreceptor to the same piece of paper on which the black image resides by a corotron transfer system; and this image is registered with the black image. The paper is held in a device which is registered with the photoreceptor and continues to circulate with the same velocity as the photoreceptor. Thereafter, the photoreceptor is cleaned and recharged negatively. Subsequently, the cyan image is then exposed onto the photoreceptor, that is the photoreceptor is exposed where one does not want the positively charged cyan toner comprised of the same styrene resin of the magenta toner, and a known cyan pigment, such as a copper phthalocyanine.

The cyan image is developed on the unexposed areas of the photoreceptor where the cyan latent CAD image is; and wherein the development system is a DC biased magnetic brush with an AC superimposed on it which uses the same small (50 microns) ferrite carrier as illustrated herein. Subsequently, the cyan toner is transferred from the photoreceptor to the same piece of paper on which the black and magenta images reside by a corotron transfer system. This image is registered with the black and magenta images as illustrated herein with respect, for example, to the black. The paper is held in a device which is registered with the photoreceptor and continues to circulate with the same velocity as the photoreceptor. Thereafter, the photoreceptor is cleaned and recharged negatively. Subsequently, a yellow image is then exposed onto the photoreceptor, that is the photoreceptor is exposed where one does not want yellow toner; and the yellow image is developed on the unexposed areas of the photoreceptor where the yellow latent CAD image is with a positively charged yellow toner comprised of the same styrene resin as utilized for the black, and a known yellow pigment, such as PERMANENT YELLOW FGL TM. The development system is a DC biased magnetic brush with an AC superimposed on it which uses the same small (50 microns) ferrite carrier as illustrated herein for the cyan. Thereafter, the yellow toner is transferred from the photoreceptor to the same piece of paper on which the black, magneta, and cyan images reside by a corotron transfer system, and this image is registered with the black, magenta, and cyan images as illustrated herein with respect to the black. After the fourth image is transferred to the paper, the paper is released and transported to the fuser to be fixed, then transported to the xerographic imaging apparatus test fixture output tray. The photoreceptor can then be cleaned and recharged negatively and the above cycles can be repeated.

The pigments for each of the above selected toners are usually present in an amount of about 5 weight percent. The carrier for each toner is as illustrated herein with respect to the black with a 0.3 weight percent coating polymer mixture.

EXAMPLE II

A toner and developer are prepared by repeating the procedures of Example I with the exceptions that there is selected as the pigment 12.5 weight percent of flushed HOSTAPERM PINK E TM comprised of 40 percent of pigment, and 60 percent of a styrene butadiene obtained from Goodyear Chemical as PLIOLITE TM, and 86.5 instead of 94 weight percent of the styrene butadiene resin. The triboelectric charge of the toner is +15 microcoulombs per gram.

EXAMPLE III

A toner and developer are prepared by repeating the procedures of Example I with the exceptions that there is selected as the pigment 3 weight percent of HOSTAPERM PINK EB TM and 96 weight percent of the styrene butadiene resin. The toner tribo is +17 microcoulombs per gram.

EXAMPLE IV

A toner and developer are prepared by repeating the procedures of Example I with the exceptions that there is selected as the pigment 7.5 weight percent of flushed HOSTAPERM PINK EB TM comprised of 40 percent of pigment, and 60 percent of a styrene butadiene obtained from Goodyear Chemical as PLIOLITE TM, and 91.5 instead of 94 weight percent of the styrene butadiene resin. The toner tribo is +17 microcoulombs per gram.

EXAMPLE V

A toner and developer were prepared by repeating the procedures of Example I with the exceptions that there was selected as the pigment 5.75 weight percent of flushed FANAL PINK D4830 TM comprised of 40 percent of pigment, and 60 percent of a styrene butadiene obtained from Goodyear Chemical as PLIOLITE TM, 1.1 weight percent of BONTRON E-88 TM, an aluminum complex charge additive obtained from Orient Chemical Company, and 93.15 instead of 94 weight percent of the styrene butadiene resin. The toner tribo was +16 microcoulombs per gram.

EXAMPLE VI

A toner and developer can be prepared by repeating the procedures of Example I with the exceptions that there is selected as the pigment 5 weight percent of LITHOL RUBINE NBD 4573 TM. The toner tribo is +19 microcoulombs per gram.

EXAMPLE VII

A toner and developer can be prepared by repeating the procedures of Example V with the exception that there is selected 1.1 weight percent of BONTRON E-84 TM, an aluminum complex charge additive obtained from Orient Chemical Company. The toner tribo is +16 microcoulombs per gram.

Other embodiments and modifications of the present invention may occur to those skilled in the art subsequent to a review of the present application; these embodiments and modifications, as well as equivalents thereof, are also included within the scope of this invention.

We claim:

1. A positively charged magenta toner consisting essentially of resin, a magenta pigment, a charge enhancing additive, and surface additive particles consisting essentially of a mixture of colloidal silica and a polymeric hydroxy compound of the formula $CH_3(CH_2)_nCH_2OH$, wherein n is a number of from about 30 to about 300, and metal oxide particles, and wherein said magenta pigment is passivated.

2. A toner in accordance with claim 1 wherein the resin is comprised of a styrene butadiene, and the magenta pigment is a FANAL PIGMENT TM.

3. A toner in accordance with claim 1 wherein the resin is comprised of a styrene acrylate, or a styrene methacrylate.

4. A toner in accordance with claim 1 wherein the charge additive is an metal complex, or distearyl dimethyl ammonium methyl sulfate.

5. A toner in accordance with claim 1 wherein the charge additive is the aluminum complex, BONTRON E-88 TM, or the zinc complex, BONTRON E-84 TM.

6. A toner in accordance with claim 1 wherein as further surface additives there are present metal salts of fatty acids.

7. A developer composition comprised of the toner of claim 1 and carrier particles.

8. A developer in accordance with claim 7 wherein the carrier is comprised of a ferrite core with a polymeric coating thereover.

9. A developer in accordance with claim 8 wherein the coating is comprised of a terpolymer of styrene, methacrylate, and an organic siloxane.

10. An imaging process which comprises (1) charging an imaging member in an imaging apparatus; (2) creating on the member a latent image comprising areas of high, intermediate, and low potential; (3) developing the low areas of potential with a first developer comprising carrier and the magenta toner of claim 1; (4) developing the high areas of potential with a second developer comprising carrier and a second toner comprised of resin, pigment, and a charge enhancing additive; (5) transferring the resulting developed image to a substrate; and (6) fixing the image thereto.

11. A process in accordance with claim 10 wherein the low and high areas of potential are developed by a conductive magnetic brush development system.

12. A process in accordance with claim 10 wherein the imaging member is comprised of a layered organic photoreceptor.

13. A process in accordance with claim 10 wherein the high level of potential is from about −750 to about −850 volts, the intermediate level of potential is from about −350 to about −450 volts, and the low level of potential is from about −100 to about −180 volts.

14. A process in accordance with claim 10 wherein the carrier has an average diameter of from about 50 to about 150 microns.

15. A process in accordance with claim 10 wherein the carrier comprises a coating of methyl terpolymer containing from 0.1 to about 40 percent by weight of carbon black at a coating weight of from about 0.4 to about 1.5 percent by weight of the carrier.

16. A process in accordance with claim 10 wherein the carrier comprises a coating comprised of a mixture of polymethyl methacrylate present in an amount of from about 80 to about 90 percent by weight, and carbon black present in an amount of from about 10 to about 20 percent by weight at a coating weight of about 1 percent by weight of the carrier.

17. A process in accordance with claim 10 wherein the carrier for the developer comprises an unoxidized steel core coated with polyvinylfluoride at a coating weight of about 0.05 percent by weight of the core wherein the carrier has a conductivity of about $7.6\times10^{-10}$ (ohm-cm)$^{-1}$.

18. A toner in accordance with claim 1 wherein there is selected a flushed magenta pigment.

19. A toner in accordance with claim 1 wherein the resin is comprised of styrene acrylates, styrene methacrylates, or styrene butadienes.

20. A toner in accordance with claim 1 wherein the metal oxide is tin oxide, and wherein n on the polymeric alcohol is a number of from about 30 to about 50.

21. A toner in accordance with claim 20 wherein the colloidal silica particles are AEROSIL ® and the polyhydroxy alcohol has a molecular weight of about 700.

22. A toner in accordance with claim 1 wherein the metal oxide is tin oxide present in an amount of 0.8 weight percent, the resin is styrene butadiene, the charge enhancing additive is distearyl dimethyl ammonium methyl sulfate, and the polyhydroxy compound has a molecular weight of about 700.

23. A toner consisting essentially of resin, flushed magenta pigment particles, a negative charge enhancing additive, and surface additive particles consisting essentially of a mixture of colloidal silica and a polymeric hydroxy compound of the formula $CH_3(CH_2)_nCH_2OH$, wherein n is a number of from about 30 to about 300, and metal oxide particles, and carrier particles comprised of a copper zinc ferrite core with a polymer coating, and wherein said flushed magneta pigment particles are passivated.

24. A toner in accordance with claim 23 wherein the charge enhancing additive is a metal complex salt.

25. A toner in accordance with claim 23 wherein the magenta pigment is FANAL PINK TM.

26. A developer comprised of the toner of claim 23 and carrier particles.

27. A process for the preparation of passivated toners consisting essentially of forming a mixture of toner resin particles, magenta pigment particles, and charge enhancing additives, and subsequently adding thereto a mixture of colloidal silica particles, metal oxide particles, and a polymeric hydroxy compound of the formula $CH_3(CH_2)_nCH_2OH$, wherein n is a number of from 30 to 300, thereby enabling passivation of said pigment particles thereby decreasing or substantially eliminating the adverse effects of the charging characteristics of said pigments on the electrical characteristics of said toner and whereby said toner, when mixed with a second toner, retains its triboelectric charging characteristics when admixed with carrier particles.

28. A developer consisting essentially of resin particles, flushed FANAL PINK TM pigment particles, and a negative charge enhancing additive comprised of an aluminum complex salt; surface additives comprised of a mixture of colloidal silica, metal oxide, and a polymeric hydroxy compound of the formula $CH_3(CH_2)_nCH_2OH$, wherein n is a number of from about 30 to about 300; and carrier particles comprised of a core with a polymeric coating and wherein said flushed FANAL PINK TM pigments are passivated.

29. A developer in accordance with claim 28 wherein the polymeric coating is comprised of two polymers, and the core is comprised of a ferrite.

30. A developer in accordance with claim 28 wherein the metal oxide is tin oxide present in an amount of 0.8 weight percent, the resin is styrene butadiene, the charge enhancing additive is distearyl dimethyl ammonium methyl sulfate, and the polyhydroxy compound has a molecular weight of about 700.

* * * * *